United States Patent [19]

Jenkins

[11] 4,162,547

[45] Jul. 31, 1979

[54] POCKET CUSPIDOR

[76] Inventor: Allen N. Jenkins, Rte. 2, West, Miss. 39192

[21] Appl. No.: 950,714

[22] Filed: Oct. 12, 1978

[51] Int. Cl.[2] ..... A61J 19/00

[52] U.S. Cl. ..... 4/259; 4/142

[58] Field of Search ..... 4/259, 258, 271, 141, 4/142, 1

[56] References Cited

U.S. PATENT DOCUMENTS

| | | | |
|---|---|---|---|
| 478,873 | 7/1892 | Koehler | 4/259 |
| 735,043 | 7/1903 | Tobin | 4/259 |
| 743,226 | 11/1903 | Beyer et al. | 4/259 |
| 1,072,695 | 9/1913 | Brotherton | 4/259 |
| 1,133,414 | 3/1915 | Sykora | 4/259 |
| 3,629,879 | 4/1971 | Forest | 4/258 |
| 3,798,682 | 3/1974 | Harreld | 4/258 X |

FOREIGN PATENT DOCUMENTS

| | | | |
|---|---|---|---|
| 251487 | 10/1912 | Fed. Rep. of Germany | 4/259 |

*Primary Examiner*—Henry K. Artis
*Attorney, Agent, or Firm*—L. S. Van Landingham, Jr.

[57] ABSTRACT

An improved pocket cuspidor is provided which preferably includes a cooperating three component system. The first component is a mouthpiece provided with a disposable waterproof flexible bag releasably secured thereto. The first component is arranged within the second component which is a first waterproof container. The second component and the first component carried thereby, in turn, are arranged within the third component, which is a second waterproof container preferably conforming in size and shape to the pocket of a garment worn by the user of the cuspidor. A cover including a stopper for the mouthpiece opening, is provided which is hingedly attached to the first container and is releasably secured to the second container when the stopper is in liquid sealing engagement with the mouthpiece opening. In another variant of the invention, the aforementioned mouthpiece and flexible bag may be eliminated to thereby provide a two component cuspidor system including the aforementioned first and second containers. In still another variant, a cuspidor is provided which includes the mouthpiece and the disposable flexible bag without the aforementioned first and second containers.

29 Claims, 5 Drawing Figures

POCKET CUSPIDOR

THE BACKGROUND OF THE INVENTION

1. The Field of the Invention

This invention broadly relates to a cuspidor. In one of its presently preferred embodiments, the invention is concerned with an improved pocket cuspidor which includes a cooperating three component system. In another embodiment, the invention provides a cuspidor system which includes two of the aforementioned components. In still another embodiment, the invention provides a cuspidor including a mouthpiece and a disposable bag releasably attached thereto as described hereinafter.

2. The Prior Art

In a number of instances, it is desirable to dispose of spitum and other types of oral secretions in a sanitary and esthetically pleasing manner. Such oral secretions may arise either from voluntary or involuntary acts on the part of an individual. Examples of instances wherein the spitum and oral secretions are due to voluntary acts include the chewing of tobacco or the dipping of snuff. Spitum and other oral secretions also may be produced involuntarily as a result of medical and/or surgical treatments or a diseased condition, such as during or following oral surgery and/or dental work, and as a result of certain diseases such as influenza, the common cold, sinus infections, tuberculosis and respiratory tract infections in general. In the interest of simplyfying the discussion and the terminology used in the appended claims, spitum and oral secretions from the aforementioned and other sources will be referred to collectively hereinafter as spitum.

Spitum is known to contain large numbers of bacteria, viruses and disease producing micro-organisms in general. Thus, it is imperative that spitum be disposed of in a sanitary manner in order to control the spread of disease, and to this end most jurisdictions have stringent laws forbidding the disposal of spitum under unsanitary conditions. This is especially true with respect to highly populated or crowded areas and in public places, such as on streets and sidewalks, in restaurants, theatres, buildings, buses, trains and subways, and at sporting events and the like.

Small portable or pocket cuspidors have been proposed heretofore for use in disposing of spitum such as, for example, the cuspidors disclosed in U.S. Pat. Nos. 630,225, 700,733, 743,226, 829,687, 907,875, 1,072,695, 1,518,302, and 1,647,427. The foregoing and other prior art pocket cuspidors have not proven to be entirely satisfactory for use under modern conditions. For example, some of the prior art cuspidors are not capable of meeting the presently existing strict sanitation requirements, and/or they are not capable of disposing of the spitum in an esthetically pleasing manner. Other prior art cuspidors are too large and/or have configurations which prevent them from being carried inconspicuously in the pocket of a modern garment, such as in the breast pocket of a sports shirt or jacket of the user. Still other prior art cuspidors are not provided with inexpensive disposable sanitary bags for the spitum which may be easily discarded when filled, and/or they are too troublesome to maintain in a sanitary condition with repeated use and too expensive to discard after each use.

It will be apparent from the foregoing that the art has long sought an entirely satisfactory pocket cuspidor which is capable of meeting even the strictest sanitation requirements, esthetically pleasing to use, sufficiently small and of a configuration which allows it to be carried inconspicuously in a shirt or jacket pocket of the user, inexpensive to purchase initially, and easily maintained in a sanitary condition by means of inexpensive disposable sanitary bags for the spitum. However, a pocket cuspidor meeting all of these requirements in combination and also entirely satisfactory in all other respects was not available prior to the present invention.

THE SUMMARY OF THE INVENTION

The present invention provides an Improved Cuspidor which overcomes the aforementioned disadvantages and deficiencies of the prior art. In one presently preferred embodiment, the cuspidor includes a cooperating three component system. The first component is a mouthpiece having a disposable waterproof bag internally threaded therethrough and releasably secured to the outside thereof, whereby only the bag is normally contacted by spitum. The first component is arranged within the second component, which is a first waterproof container. The first and second components are, in turn, arranged within a third component, which is a second waterproof container preferably of a size and shape to conform to a pocket of the user. The second component has a cover including a stopper for the mouthpiece opening hingedly attached thereto. The cover is releasably secured to the third component when the stopper is in liquid sealing engagement with the mouthpiece opening.

The foregoing arrangement of the first, second and third components assures that sanitary conditions are maintained at all times. Also, the cuspidor may be carried in an inconspicuous manner in a pocket while waiting use periodically.

Reference may be had to the accompanying drawings and to the detailed description appearing hereinafter for a more complete understanding of the above and other presently preferred embodiments of the invention. For instance, in another embodiment of the invention, the mouthpiece and bag are eliminated to thereby provide a two component cuspidor system including the forementioned first and second containers. In still another embodiment, a cuspidor is provided which includes the mouthpiece and the disposable bag without the first and second containers.

THE BRIEF DESCRIPTION OF THE DRAWINGS

The invention will be described in greater particularity hereinafter with reference to the presently preferred embodiments illustrated in the accompanying drawings, wherein.

Figure 3:
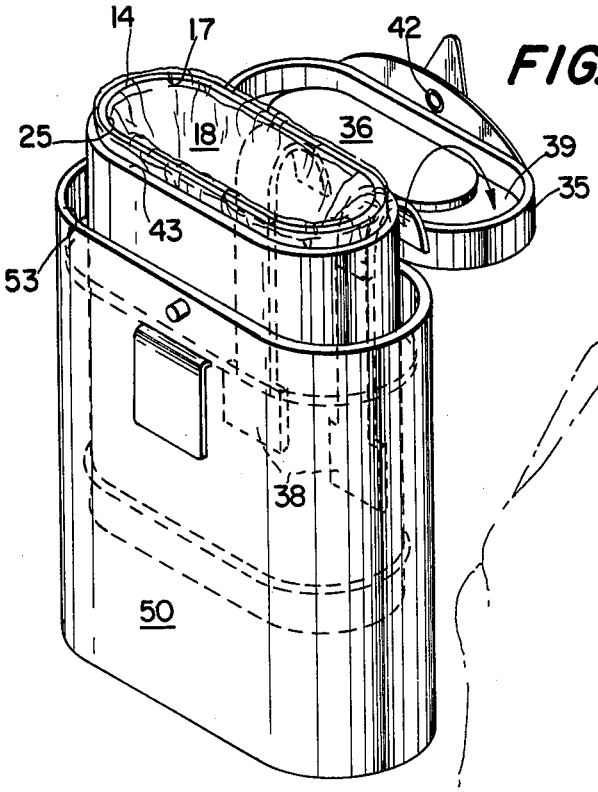
FIG. 3 is a perspective view of the assembled pocket cuspidor of the invention, with the stopper therefor being opened and folded back whereby the first and second components are raised upward from the position illustrated in FIG. 6 to the position illustrated in FIG. 3.
Figure 4:
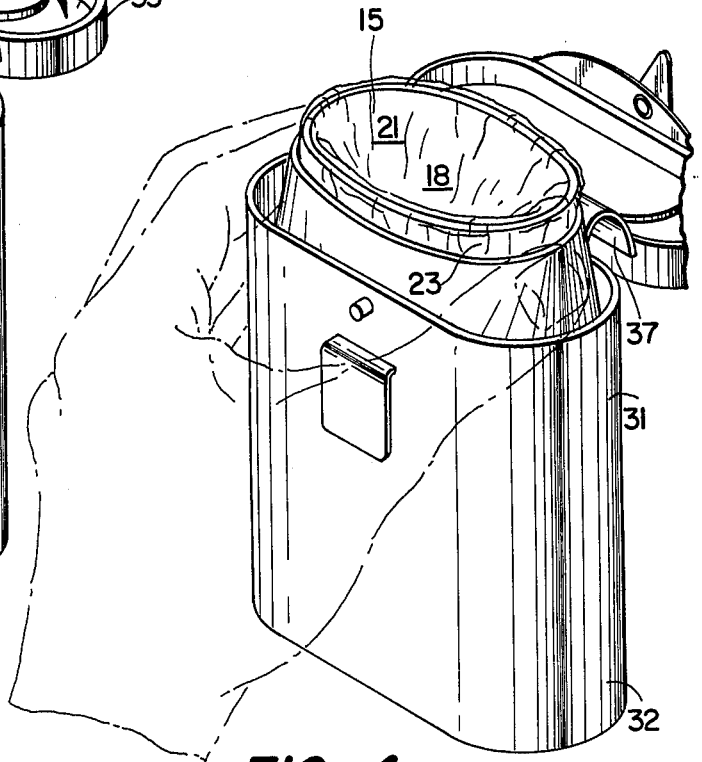
Figure 5:
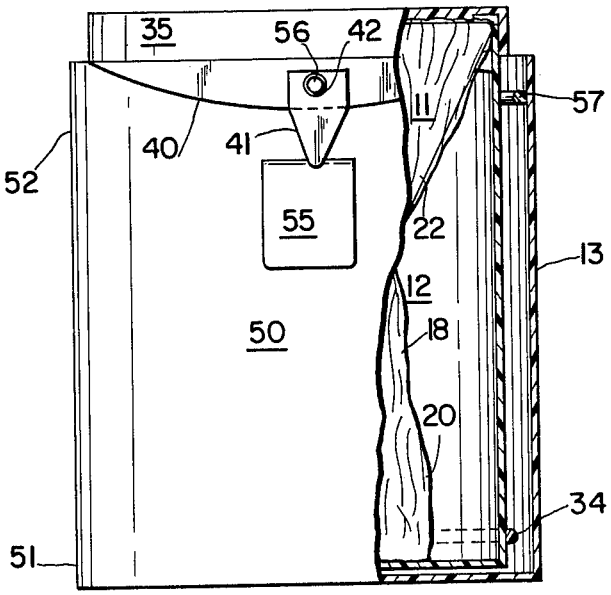

FIG. 4 is a perspective view similar to FIG. 3, illustrating the effect of the application of pressure to either side of the initially oblong openings in the flexible tops of the first and second components to thereby render the same more circular in configuration; and FIG. 5 is a view in elevation of the assembled three component pocket cuspidor of the invention, with the stopper therefor being in the closed position, and with a portion thereof being broken away to further illustrate the internal arrangement of the first and second components within the third component.

It is understood that the aforementioned five figures of the drawings are merely illustrative of the invention, and that the invention is not limited thereto.

THE DETAILED DESCRIPTION OF THE INVENTION INCLUDING THE PRESENTLY PREFERRED EMBODIMENTS THEREOF

Referring now to the drawings, the pocket cuspidor generally designated as 10 includes a first component 11, a second component 12 and a third component 13. The first, second and third components 11, 12 and 13 may be constructed of any suitable waterproof flexible material, but preferably they are constructed of a plastic such as polyethylene, or other plastics of the types commonly used in containers. Other materials of construction include, for example, heavy paper, light cardboard, light pressed board stock and other paper board products useful in preparing waterproof containers such as milk cartons which have been waterproofed with wax, plastic coatings, or other waterproofing agents.

The first component 11 includes a flexible waterproof mouthpiece 14 having an upper end portion 15 and a lower end portion 16. The mouthpiece 14 has a generally oblong opening 17 extending therethrough between the upper end 15 and the lower end 16. A flexible waterproof bag 18 is provided having an upper end portion 19 and a lower end portion 20 and an interior surface 21 and an exterior surface 22. The bag 18 is open at its upper end 19 and is closed at its lower end 20, and it likewise may be constructed of flexible plastic or other suitable inexpensive waterproof materials as described above and thus it is disposable.

The upper end 19 of bag 18 is passed upward through the oblong opening 17 in the mouthpiece 14, which increases in width along the longitudinal axis as it extends from the lower end 16 to the upper end 15. The upper end 19 is pulled upward through the mouthpiece opening 17 a substantial distance past the upper end 15. The upper end 19 is opened and then folded in its open condition around the edge of the upper end 14, and it is thereafter passed downward onto the outer surface 23 of mouthpiece 14. Thus, the exterior surface 22 of the upper end portion 19 is in contact with the internal surface 25 of mouthpiece 14 and the outer surface 23. A rubber band 24 releasably retains the upper end 19 of bag 18 on the outer surface 23 of mouthpiece 14 at a point a substantial distance beneath the edge of upper end 15 during use of the cuspidor.

The above arrangement allows spitum to be introduced into the interior of bag 18 via the open upper end 19 thereof and to be retained therein by the closed lower end 20. The spitum is in contact only with the interior surface 21 and it does not contact the exterior surface 22 when the bag 18 is in the upright position illustrated in the drawings. During use of the cuspidor 10, misdirected spitum is deposited on the exposed interior surface 21 of the upper end portion 19 of bag 18. The exterior surface 22, which is in contact at all times with the outer surface 23 and inner surface 25 of mouthpiece 14, likewise remains sanitary and free of spitum at all times as do the surfaces 23 and 25. When the bag 18 has been filled with spitum, it may be removed by releasing the rubber band 24 and pulling downward on lower end 20. Thus, the upper end 19 may be pulled downward and removed from the opening 17 without the spitum coated interior surface 21 thereof touching any portion of the mouthpiece 14. Thereafter, the contents of bag 18 may be disposed of in a sanitary manner by simply discarding the used bag 18, and then it is replaced with a fresh bag 18 in the manner previously described.

The second component 10 is a waterproof first container 30 having an upper end portion 31 and a lower end portion 32. The container 30 has an opening 43 in its upper end 31, and it is closed at its lower end 32, to thereby provide a waterproof container having an interior 44 for receiving the first component 11. The container 30 is also provided with a pair of oppositely disposed internally extending projections 33 which extend through the pair of oppositely disposed openings 26 in upper end 15 of mouthpiece 14. The container 30 has an annular projection 34 which extends outward from the exterior surface of lower end 32 to thereby effectively increase the circumference thereof at that point.

The openings 17 and 43 in the mouthpiece 14 and container 30, respectively, are substantially longer than their widths to thereby provide generally oblong openings which are closely adjacent and have generally longitudinal and transverse axis. The opening 43 is of a size and configuration to receive the upper end 15 of the mouthpiece 14 in a closely nestled relationship, and with the internal projections 33 extending through the openings 36 to thereby releasably retain the mouthpiece 14 in place. Preferably, the upper end 15 of mouthpiece 14 projects outward a short distance from the upper end 31 of container 30 as illustrated in FIGS. 3 and 4. Also, the length of bag 18 is sufficient for the bottom thereof to be supported by the internal bottom surface of container 30 as illustrated in FIG. 5.

The upper end 31 of container 30 is also provided with a hingedly mounted cover 35 which includes a stopper 36. The cover 35 is hingedly mounted on container 30 by means of a pair of spaced straps 37, which are attached at their lower ends on the external surface of container 30 at spaced points 38, and at their upper ends to the outer surface of cover 35. The mounting points 38 are located a substantial distance beneath the upper edge of container 30, whereby the folding back and lifting up on cover 35, the first and second components may be pulled upward from the third component 13 to the position illustrated in FIG. 3 or higher. The stopper 36 is of a size and configuration to be received by the opening 17. When the stopper 35 is positioned within opening 17, the open upper end 19 of bag 18 is between the circumference of the stopper and the internal surface 25 and is retained therein in substantially watertight sealing relationship. The cover 35 also has an internal annular area 39 between the outer circumference of stopper 36 and the internal circumference of cover 35. The annular area 39 is of a size and configuration to cover the opening 43 when the cover 35 is in the position illustrated in FIG. 5. The cover 35 is also provided with a flap 40 to which is affixed a tab 41, and through which extends an opening 43.

The third component 13 is a second waterproof container 50 having an upper end portion 51 and a lower end portion 52. The second container 50 has an opening 53 in the upper end 51, and is closed at the lower end thereof. The opening 53 is of a size and configuration to receive the closed lower end of container 30. The container 50 has an elongated interior 54 in communication with opening 53 of a size and configuration to receive the container 30. As is best seen in FIGS. 2–5, the closed lower end of the container 30 is inserted through the opening 53 in container 50 and normally at least a major portion of the first container is positioned within the interior 54. The second container 50 is also provided with an internally arranged annular projection 57 located on the internal surface of the upper end 51.

Preferably, the container 50 is of a size and shape to fit conveniently in the pocket of a garment worn by the user of the cuspidor, such as in a shirt pocket or jacket pocket. The outer surface of container 50 is provided with a clip 55 for releasably retaining the cuspidor 10 in the pocket of the user. The outwardly projecting stud 56 is inserted through the opening 43 in flap 40 and tab 41 for the purpose of retaining the cover 35 in the closed position illustrated in FIG. 5 of the drawings.

Figure 2:
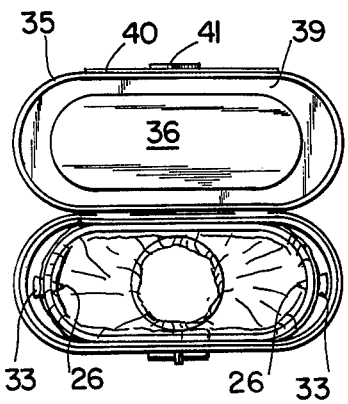
FIG. 2 is a top view of the assembled three component pocket cuspidor of the invention, with the stopper therefor being in the open position further illustrated in FIG. 3.

In most instances, it is preferred to use all three of the components 11, 12 and 13 as illustrated in FIGS. 2–4 of the drawings. The pocket cuspidor 10 is usually carried in the breast pocket, for example, of a garment with the clip 55 retaining it in the pocket until use. When it is desired to use the pocket cuspidor 10, it may be removed from the pocket, and the tab 41 is raised upward to remove the stud 56 from opening 42 and thereby allow the cover 35 to be folded back to the position illustrated in FIGS. 2–4. When the cover is in this position, the components 11 and 12 may be pulled toward from component 13 to the position illustrated in FIGS. 3 and 4, and the cuspidor is then ready for use. If desired, it is possible to cause the initially oblong opening 17 in mouthpiece 14 to become shorter and wider and take on a more circular configuration whereby the cuspidor is easier to use. This is accomplished by applying pressure to opposite sides of the openings 17 and 43 and causing the flexible materials from which the mouthpiece 14 and container 30 are formed to be deformed in a direction generally along the longitudinal axes and toward the transverse axes as illustrated in FIG. 4 of the drawings.

Figure 1:
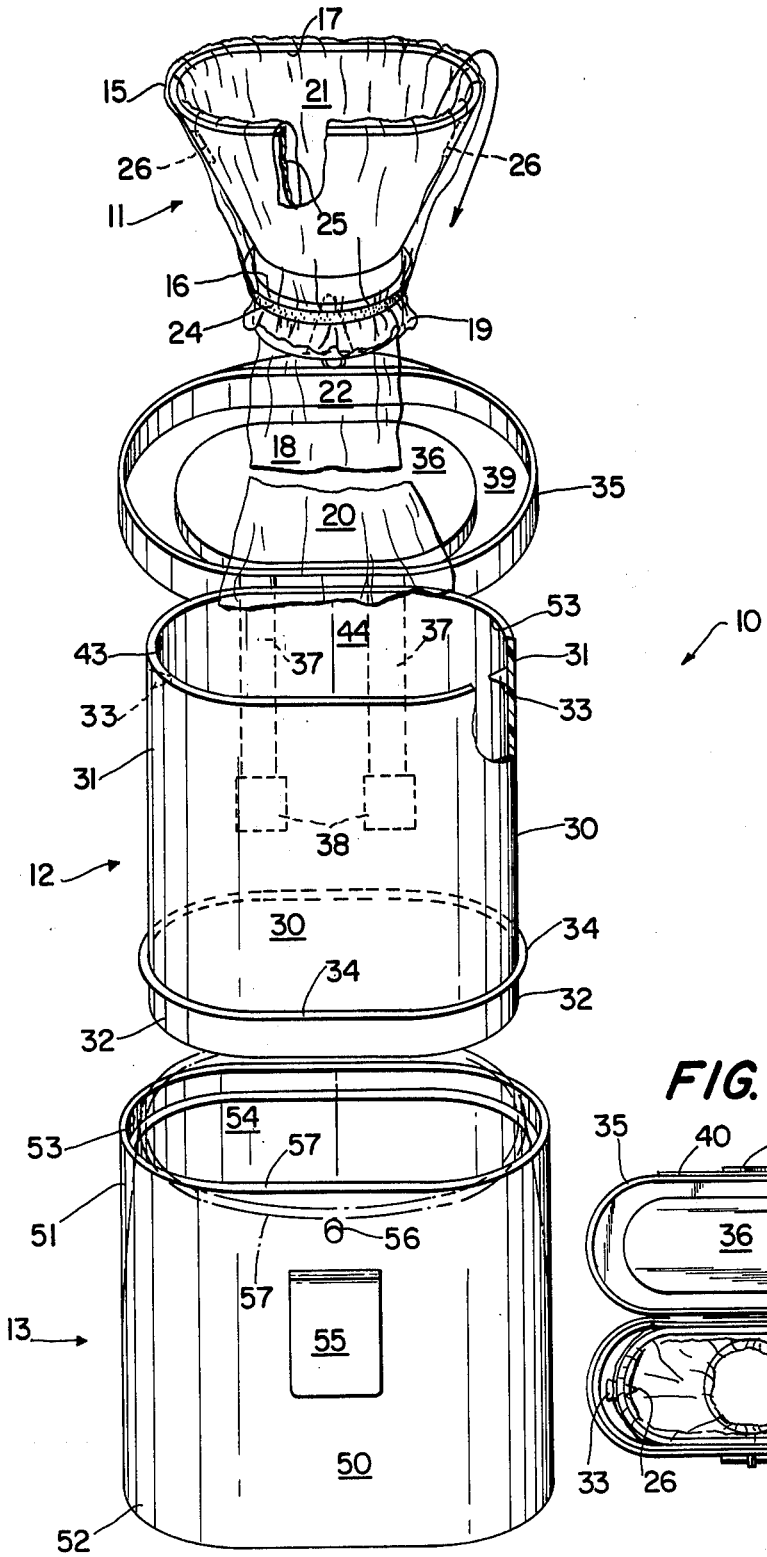
FIG. 1 is an exploded view illustrating, from top to bottom, the first, second and third components of the pocket cuspidor of the invention.

As is best seen in FIGS. 1 and 3, the annular projections 34 and 57 cooperate to allow the first and second components to be raised and lowered a predetermined distance when positioned within the interior 54 of container 50. For example, the size and configuration of the initially oblong opening 53 and annular projection 57 are such as to allow annular projection 34 to pass therethrough only when opening 53 and annular projection 57 are deformed to the position illustrated in phantom line in FIG. 1. Thus, when it is desired to insert or remove the second component, pressure is applied to opposite sides of the flexible upper end portion 51 to thereby cause the annular projection 57 to take on the configuration shown in phantom line in FIG. 1. This allows the annular projection 34 to pass through the annular projection 57 and the second component may be either fully inserted or removed from the third component. When it is desired to retain the second component within the third component, then the pressure is not applied to the upper end portion 51. This causes the annular projection 57 to take on the configuration illustrated in solid line whereby the annular projection 34 cannot pass therethrough due to its relative size and configuration. Following use, the second component is returned from the position illustrated in FIGS. 3 and 4 of the drawings to the position illustrated in FIG. 5. The cover 35 is then replaced as is shown in FIG. 5 and the pocket cuspidor 10 is returned to the pocket of the user.

If desired, it is possible to use only the first component as a cuspidor. This embodiment of the invention is especially useful in a dentist's office, and especially during or following oral surgery or other dental work. The mouthpiece 14 with the bag 18 attached thereto may be held in the hand during use, and the bag 18 is disposed of as needed and replaced with a fresh bag 18. In still another embodiment, the first component may be inserted within the second component and used without the third component. In still another embodiment of the invention, the first component may be eliminated and only the second and third components are used. Inasmuch as the cover 35 has an annular area 39 which covers the opening 43, the cuspidor may be covered although it is not necessarily watertight.

It is understood that the foregoing detailed description and the accompanying drawings are for purposes of illustration only, and are not intended as being limiting to the spirit or scope of the present invention as defined by the appended claims.

I claim:

1. A cuspidor comprising a mouthpiece having an upper end and a lower end, the mouthpiece having an opening extending therethrough between the upper end and the lower end, a flexible waterproof bag having an upper end and a lower end and an interior surface and an exterior surface, the said bag being open at its upper end and closed at its lower end whereby spitum may be introduced into the interior thereof via the open end and retained therein by the closed lower end in contact with the said interior surface and out of contact with the said exterior surface when the bag is in an upright position, the said upper end of the bag being passed upward through the said opening in the mouthpiece from the lower end of the mouthpiece opening to the upper end thereof, the said upper end of the bag also being passed upward through the mouthpiece opening a substantial distance past the said upper end of the mouthpiece and being opened and folded in its open condition around the opening in the said upper end of the mouthpiece and then passed downward onto the outer surface of the mouthpiece whereby the exterior surface of the upper end portion of the bag is in contact with the opening in the mouthpiece and the outer surface thereof and the interior surface of the upper end portion of the bag is exposed, and retaining means carried by the mouthpiece for releasably retaining the said open upper end portion of the bag thereon, the retaining means being effective to retain the said upper end of the bag on the outer surface of the mouthpiece at a point a substantial distance beneath the top thereof during use of the cuspidor whereby misdirected spitum is deposited on the resultant exposed interior surface of the upper end portion of the bag, and the retaining means being adapted to be released following use of the cuspidor whereby upon release of the retaining means the said upper end of the bag may be pulled downward through the mouthpiece opening and the bag removed from the mouthpiece without the interior surface of the bag touching the mouthpiece and whereby the contents of the bag may be disposed of in a sanitary manner.

2. The cuspidor of claim 1 wherein the configuration of the said opening in the mouthpiece at its upper end is substantially longer than its width to thereby provide initially a generally oblong mouthpiece opening having generally longitudinal and transverse axes, and the mouthpiece is formed from a flexible material which is deformed while pressure is applied to opposite sides of the mouthpiece in directions generally along the said longitudinal axis and generally towards the said transverse axis whereby the initially oblong mouthpiece opening becomes shorter and wider and takes on a more circular configuration.

3. The cuspidor of claim 1 wherein the said mouthpiece and bag are formed of plastic.

4. The cuspidor of claim 1 wherein a stopper is provided of a size and shape to conform with the upper mouthpiece opening, and the said stopper is positioned in the opening in the said upper end of the mouthpiece and in the opening in the said upper end of the bag whereby the opened bag is between the circumference of the stopper and the internal surface of the opening and is retained therein in a substantially watertight sealing relationship.

5. The cuspidor of claim 1 wherein the said bag is formed of plastic, the configuration of the said opening in the mouthpiece at its upper end is substantially longer than its width to thereby provide initially a generally oblong mouthpiece opening having generally longitudinal and transverse axis, and the mouthpiece is formed from a flexible plastic material which is deformed while pressure is applied to opposite sides of the mouthpiece in directions generally along the said longitudinal axis and generally towards the said transverse axis whereby the initially oblong mouthpiece opening becomes shorter and wider and takes on a more circular configuration.

6. The cuspidor of claim 5 wherein a stopper is provided of a size and shape to conform with the upper mouthpiece opening, and the said stopper is positioned in the opening in the said upper end of the mouthpiece and in the opening in the said upper end of the bag whereby the opened bag is between the circumference of the stopper and the internal surface of the opening and is retained therein in a substantially watertight sealing relationship.

7. The cuspidor of claim 1 wherein a waterproof first container is also provided, the said first container having an open upper end and a closed lower end, means is provided for releasably retaining the said mouthpiece and the open upper end of the bag carried thereby in the said open upper end of the first container, the said upper end of the mouthpiece and the said open upper end of the bag being positioned adjacent the said open upper end of the first container, and the said lower end of the mouthpiece and the said closed lower end of the bag being positioned within the interior of the container.

8. The cuspidor of claim 7 wherein the configurations of the said openings in the mouthpiece and first container at their upper ends are substantially longer than their widths to thereby provide initially generally oblong openings which are closely adjacent and have generally longitudinal and transverse axis, and the mouthpiece and first container are formed from flexible material which is deformed while pressure is applied to opposite sides thereof in the vicinity of the said open upper ends in directions generally along the said longitudinal axes and towards the said transverse axes whereby the initially oblong openings in the first container and mouthpiece become shorter and wider and take on a more circular configuration.

9. The cuspidor of claim 7 wherein the said mouthpiece, bag and first container are formed of plastic.

10. The cuspidor of claim 7 wherein a stopper is provided of a size and shape to conform with the upper mouthpiece opening, and the said stopper is positioned in the opening in the said upper end of the mouthpiece and in the opening in the said upper end of the bag whereby the opened bag is between the circumference of the stopper and the internal surface of the opening and is retained therein in a substantially watertight sealing relationship.

11. The cuspidor of claim 7 wherein the said mouthpiece, bag and first container are formed of plastic, the configurations of the said openings in the mouthpiece and first container at their upper ends are substantially longer than their widths to thereby provide initially generally oblong openings which are closely adjacent and have generally longitudinal and transverse axes, and the mouthpiece and first container are formed from flexible material which is deformed while pressure is applied to oppposite sides thereof in the vicinity of the said open upper ends in directions generally along the said longitudinal axes and towards the said transverse axes whereby the initially oblong openings in the first container and mouthpiece become shorter and wider and take on a more circular configuration.

12. The cuspidor of claim 11 wherein a stopper is provided of a size and shape to conform with the upper mouthpiece opening, and the said stopper is positioned in the opening in the said upper end of the mouthpiece and in the opening in the said upper end of the bag whereby the opened bag is between the circumference of the stopper and the internal surface of the opening and is retained therein in a substantially watertight sealing relationship.

13. The cuspidor of claim 7 wherein a waterproof second container is also provided, the said second container having an open upper end and a closed lower end, the said opening in the upper end of the second container being of a size to receive the said closed lower end of the first container, the said second container having an elongated interior in communication with the opening in the upper end thereof of a size to receive at least a major portion of the said first container, and the said closed lower end of the first container being inserted through the said opening in the upper end of the second container and normally at least a major portion of the said first container being positioned within the interior of the second container.

14. The cuspidor of claim 13 wherein the said second container is of a size and shape to conform to a pocket in a garment, and means carried by the second container is provided for releasably retaining the cuspidor in the said pocket.

15. The cuspidor of claim 13 wherein the said mouthpiece, bag, first container and second container are formed of plastic.

16. The cuspidor of claim 13 wherein a stopper is provided of a size and shape to conform with the upper mouthpiece opening, the said stopper normally is positioned in the opening in the said upper end of the mouthpiece and in the opening in the said upper end of the bag whereby the opened bag is between the circumference of the stopper and the internal surface of the opening and is retained therein in a substantially water tight sealing relationship, hinge means carried by the said first container for hingedly mounting the stopper on the first container, the hinge means including elongated flexible strap means having first and second end portions, and the first end portion of the strap means being attached to one side of the stopper and the second end portion of the strap means being attached to the outer surface of the first container at a point remote from the upper and lower ends thereof whereby when it is desired to use the cuspidor, the stopper may be removed from the mouthpiece opening and the first container may be pulled outward from its normal position within the interior of the said second container by pulling outward on the stopper and the strap means attached thereto.

17. The cuspidor of claim 16 wherein cooperating releasable retaining means carried by the stopper and the said second container are provided for releasably retaining the stopper in its normal position in the mouthpiece opening and also for retaining the said first container in its normal position within the interior of the said second container.

18. The cuspidor of claim 13 wherein the configurations of the said openings in the mouthpiece, first container and second container at their upper ends are substantially longer than their widths to thereby provide initially generally oblong openings which have generally longitudinal and transverse axes, and the mouthpiece, first container and second container are formed from flexible material which is deformed when pressure is applied to opposite sides thereof in the vicinity of the said open upper ends thereof in directions generally along the said longitudinal axes and towards the said transverse axes whereby the initially oblong openings in the mouthpiece, first container and second container become shorter and wider and take on a more circular configuration.

19. The cuspidor of claim 18 wherein cooperating releasable first and second container retaining means are provided on the outer surface of the bottom portion of the said first container and on the inner surface of the upper portion of the said second container for preventing the said first container from being withdrawn completely from the interior of the said second container when the said pressure is not applied to the said second container, the said first and second container retaining means being rendered ineffective when the said pressure is applied to the said second container whereby thereupon the said first container may be removed completely from within the interior of the said second container.

20. The cuspidor of claim 19 wherein a stopper is provided of a size and shape to conform with the upper mouthpiece opening, the said stopper normally is positioned in the opening in the said upper end of the mouthpiece and in the opening in the said upper end of the bag whereby the opened bag is between the circumference of the stopper and the internal surface of the opening and is retained therein in a substantially water tight sealing relationship, hinge means carried by the said first container for hingedly mounting the stopper on the first container, the hinge means including elongated flexible strap means having first and second end portions, the first end portion of the strap means being attached to one side of the stopper and the second end portion of the strap means being attached to the outer surface of the first container at a point remote from the upper and lower ends thereof whereby when it is desired to use the cuspidor the stopper may be removed from the mouthpiece opening and the first container may be pulled outward from its normal position within the interior of the said second container by pulling outward on the stopper and the strap means attached thereto, and cooperating releasable retaining means carried by the stopper and the said second container are provided for releasably retaining the stopper in its normal position in the mouthpiece opening and also for retaining the said first container in the normal position within the interior of the said second container.

21. The cuspidor of claim 20 wherein the said mouthpiece, bag, first container and second container are formed of plastic.

22. The cuspidor of claim 21 wherein the said second container is of a size and shape to conform to a pocket in a garment, and means carried by the second container is provided for releasably retaining the cuspidor in the said pocket.

23. A cuspidor comprising a waterproof first container, the said first container having an open upper end and a closed lower end, a waterproof second container, the said second container having an open upper end and a closed lower end, the said opening in the upper end of the second container being of a size to receive the said closed lower end of the first container, the said second container having an elongated interior in communication with the opening in the upper end thereof of a size to receive at least a major portion of the said first container, the said closed lower end of the first container being inserted through the said opening in the upper end of the second container and normally at least a major portion of the said first container being positioned within the interior of the second container, stopper means of a size and shape to conform with the opening in the said upper end of the first container, the said stopper means normally closing off the opening in the said upper end of the first container, hinge means carried by the said first container for hingedly mounting the stopper means on the first container, the hinge means including elongated flexible strap means having first and second end portions, and the first end portion of the strap means being attached to one side of the stopper means and the second end portion of the strap means being attached to the outer surface of the said first container at a point remote from the upper and lower ends thereof whereby when it is desired to use the cuspidor, the stopper means may be removed from its normal position and the first container may be pulled outward from its normal position within the interior of the said second container by pulling outward on the stopper means and the strap means attached thereto.

24. The cuspidor of claim 23 wherein cooperating releasable retaining means carried by the stopper means and the said second container are provided for releasably retaining the stopper means in its normal position and also for retaining the said first container in its normal position within the interior of the said second container.

25. The cuspidor of claim 23 wherein the configuration of the said openings in the first container and second container at their upper ends are substantially longer than their widths to thereby provide initially generally oblong openings which have generally longitudinal and transverse axes, and the said first container and second container are formed from flexible material which is deformed when pressure is applied to opposite sides thereof in the vicinity of the said open upper ends thereof in directions generally along the said longitudinal axes and towards the said transverse axes whereby the initially oblong openings in the said first container and second container become shorter and wider and take on a more circular configuration.

26. The cuspidor of claim 25 wherein cooperating releasable first and second container retaining means are provided on the outer surface of the bottom portion of the said first container and on the inner surface of the upper portion of the said second container for preventing the said first container from being withdrawn completely from the interior of the said second container when the said pressure is not applied to the said second container, the said first and second container retaining means being rendered ineffective when the said pressure is applied to the said second container whereby thereupon the said first container may be removed completely from within the interior of the said second container.

27. The cuspidor of claim 26 wherein cooperating releasable retaining means carried by the stopper means and the said second container are provided for releasably retaining the stopper means in the normal position and also for retaining the said first container in its normal position within the interior of the said second container.

28. The cuspidor of claim 21 wherein the said second container is of a size and shape to conform to a pocket in a garment, and means carried by the second container is provided for releasably retaining the cuspidor in the said pocket.

29. The cuspidor of claim 20 wherein the said mouthpiece, bag, first container and second container are formed of plastic.

* * * * *